US010618778B2

(12) United States Patent
Hu et al.

(10) Patent No.: US 10,618,778 B2
(45) Date of Patent: Apr. 14, 2020

(54) OPENABLE EXTENSIBLE PANEL AND ELEVATOR CEILING, CAR AND SYSTEM WITH THE SAME

(71) Applicant: Otis Elevator Company, Farmington, CT (US)

(72) Inventors: Xiaopeng Hu, Hangzhou (CN); ChunYan Yu, Hangzhou (CN); Jingli Zhou, Hangzhou (CN); YuFeng Wu, Hangzhou (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 182 days.

(21) Appl. No.: 15/837,722

(22) Filed: Dec. 11, 2017

(65) Prior Publication Data

US 2018/0162698 A1 Jun. 14, 2018

(30) Foreign Application Priority Data

Dec. 13, 2016 (CN) ..... 2016 1 1144154

(51) Int. Cl.
*B66B 11/02* (2006.01)
*B66B 9/00* (2006.01)

(52) U.S. Cl.
CPC ..... *B66B 11/0226* (2013.01); *B66B 11/0233* (2013.01); *B66B 9/00* (2013.01)

(58) Field of Classification Search
CPC .... B66B 11/0226; B66B 11/0233; B66B 9/00
See application file for complete search history.

(56) References Cited

U.S. PATENT DOCUMENTS 627,257 A * 6/1899 Haines et al. ..... B66B 5/027 187/313
837,826 A * 12/1906 Handlan ..... B66B 5/027 187/313
4,357,993 A * 11/1982 Halpern ..... B66B 11/0253 187/401

(Continued)

FOREIGN PATENT DOCUMENTS

CN 102161454 A 8/2011
CN 202704764 U 1/2013

(Continued)

OTHER PUBLICATIONS

European Search Report for application EP 17207152.4, dated May 4, 2018, 11 pages.

*Primary Examiner* — Michael A Riegelman
(74) *Attorney, Agent, or Firm* — Cantor Colburn LLP

(57) ABSTRACT

The present invention provides an openable extended panel, and a lift ceiling, lift car and lift system having same, wherein the openable extended panel is mounted to a support frame and is in positional correspondence to an escape exit at a car roof; the openable extended panel is rotatably connected to the support frame at a first side, and the openable extended panel is connected to the support frame via an intermediate member at a second side opposite to the first side, the support frame and the openable extended panel being respectively detachably connected to the intermediate member. The openable extended panel according to the embodiments of the present invention has a simple structure, and can be easily opened.

20 Claims, 4 Drawing Sheets

(56) References Cited

U.S. PATENT DOCUMENTS

| | | | | | |
|---|---|---|---|---|---|
| 4,635,756 | A * | 1/1987 | Sherwood | B66B 11/0253 | 187/401 |
| 4,700,809 | A * | 10/1987 | Lazar | B66B 11/0253 | 187/401 |
| 4,711,322 | A * | 12/1987 | Orndorff | E04B 9/18 | 187/401 |
| 4,712,651 | A * | 12/1987 | Sherwood | B66B 11/0233 | 187/401 |
| 5,412,542 | A * | 5/1995 | Mandy | B66B 11/0233 | 187/390 |
| 6,523,648 | B2 * | 2/2003 | Bloch | B66B 11/0233 | 187/414 |
| 7,066,617 | B2 * | 6/2006 | Mandy | B66B 11/0233 | 362/147 |
| 7,469,773 | B2 * | 12/2008 | Yoon | B66B 11/0226 | 187/313 |
| 8,141,683 | B1 * | 3/2012 | Wurth | B66B 19/00 | 182/223 |
| 9,051,158 | B2 | 6/2015 | Zhang | | |
| 9,193,566 | B1 * | 11/2015 | Nieves | B66B 11/0226 | |
| 9,546,078 | B2 * | 1/2017 | Paasisalo | B66B 11/0226 | |
| 2012/0181117 | A1 * | 7/2012 | Chasteen | B66B 11/0233 | 187/392 |
| 2012/0255815 | A1 * | 10/2012 | Koskelainen | B66B 5/027 | 187/401 |
| 2013/0333984 | A1 | 12/2013 | Gressien et al. | | |
| 2014/0305749 | A1 * | 10/2014 | Manner | B66B 11/0226 | 187/401 |
| 2015/0175388 | A1 * | 6/2015 | Klappholz | B66B 11/0226 | 187/401 |
| 2016/0122159 | A1 | 5/2016 | Delachatre et al. | | |
| 2016/0145863 | A1 * | 5/2016 | Bergman | E04B 9/225 | 52/506.05 |
| 2017/0144862 | A1 * | 5/2017 | Fernandez | B66B 11/0246 | |
| 2018/0105394 | A1 * | 4/2018 | Hill | B66B 11/0226 | |
| 2018/0105395 | A1 * | 4/2018 | Cortes | B66B 5/0087 | |
| 2018/0111797 | A1 * | 4/2018 | Fauconnet | B66B 11/0253 | |
| 2018/0222723 | A1 * | 8/2018 | Gressien | B66B 5/0087 | |

FOREIGN PATENT DOCUMENTS

| | | | |
|---|---|---|---|
| CN | 103848325 | A | 6/2014 |
| CN | 204265187 | U | 4/2015 |
| CN | 204265188 | U | 4/2015 |
| CN | 105858411 | A | 8/2016 |
| CN | 205527201 | U | 8/2016 |
| EP | 1950166 | B1 | 5/2014 |
| JP | S5436271 | U | 3/1979 |
| JP | 2011184113 | A | 9/2011 |
| JP | 2015027898 | A | 2/2015 |

* cited by examiner

OPENABLE EXTENSIBLE PANEL AND ELEVATOR CEILING, CAR AND SYSTEM WITH THE SAME

FOREIGN PRIORITY

This application claims priority to Chinese Patent Application No. 201611144154.3, filed Dec. 13, 2016, and all the benefits accruing therefrom under 35 U.S.C. § 119, the contents of which in its entirety are herein incorporated by reference.

TECHNICAL FIELD

The present invention relates to the technical field of lift decoration, and more particularly, the present invention relates to an openable extended panel for a lift ceiling, and a lift ceiling, car and system having same.

BACKGROUND

At present, the requirements for lift decoration is increasingly higher, especially the lift ceiling. The lift ceiling not only needs to have an attractive appearance to satisfy decorative requirements, but also need to be provided with various functional components, for example, an overhead light, a ventilation opening etc. Now, the lift ceiling should also be openable during emergency so as to have an access to the escape exit of the car roof.

SUMMARY OF INVENTION

The aim of the invention is to address or at least alleviate the problems in the prior art.

For achieving the above-mentioned or other objects, according to one aspect of the present invention, provided is an openable extended panel for a lift ceiling, mounted to a support frame and in positional correspondence to an escape exit of the car roof;

wherein the openable extended panel is rotatably connected to the support frame at a first side, and the openable extended panel is connected to the support frame via an intermediate member at a second side opposite to the first side;

wherein the support frame and the openable extended panel are respectively detachably connected to the intermediate member.

According to other aspects of the present invention, also provided are a lift ceiling, car and system having an openable extended panel according to the embodiments of the present invention.

BRIEF DESCRIPTION OF THE DRAWINGS

The principle of the present invention would become more apparent by reading the detailed description below in conjunction with the accompanying drawings, wherein.

DETAILED DESCRIPTION

It would be easily understood that, according to the technical solutions of the invention, a person of ordinary skill in the art can propose multiple alternative constructions and implementations without altering the essential spirit of the invention. Therefore, the following particular embodiments and accompanied drawings are merely exemplary explanation of the technical solutions of the invention, and should in no way be considered as the entirety of the invention or be considered as constrictions or limitations to the technical solutions of the invention.

Orientation phases such as "up", "down", "left", "right", "front", "back," "front side", "back side", "top", "bottom" or the like mentioned or may be mentioned in the specification are defined relative to the constructions shown in the various accompanying drawings, are relative concepts, and thus may accordingly be varied according to their different locations and different usage stages. Therefore, these or other orientation phases should not be construed as limiting either.

Figure 1:
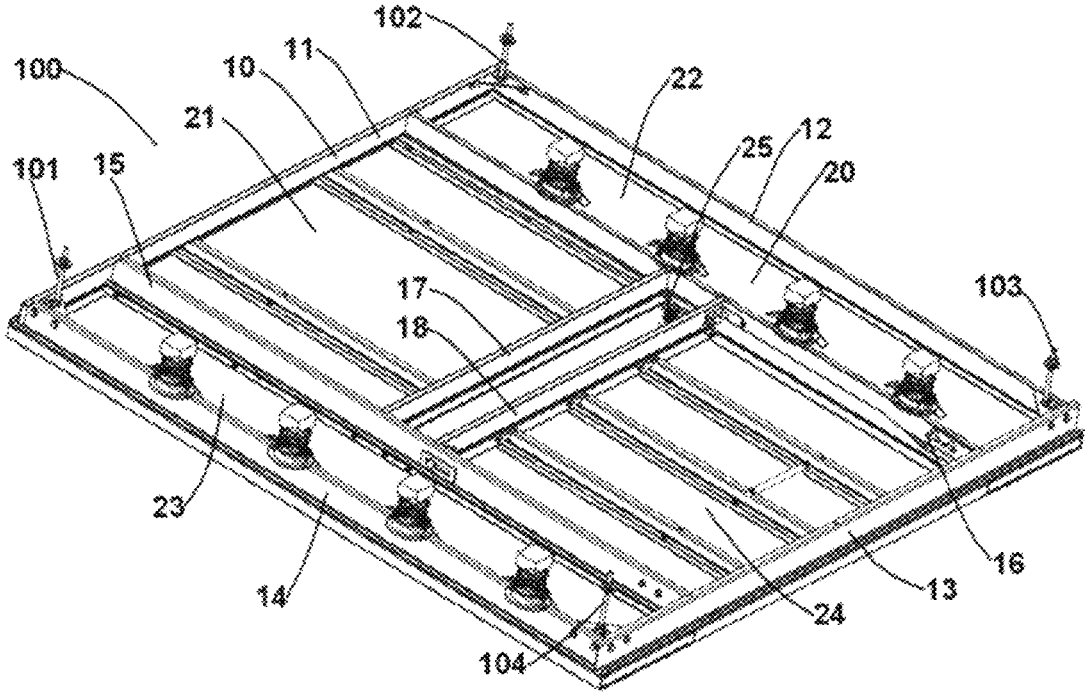
FIG. 1 shows a stereogram of a lift ceiling according to one embodiment of the present invention.
Figure 2:
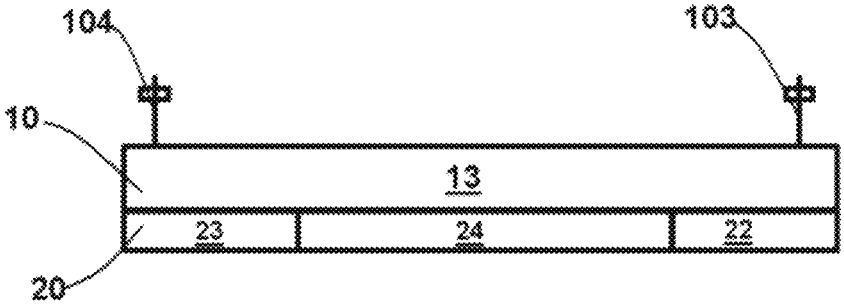
FIG. 2 shows a side view of a lift ceiling according to one embodiment of the present invention.
Figure 3:
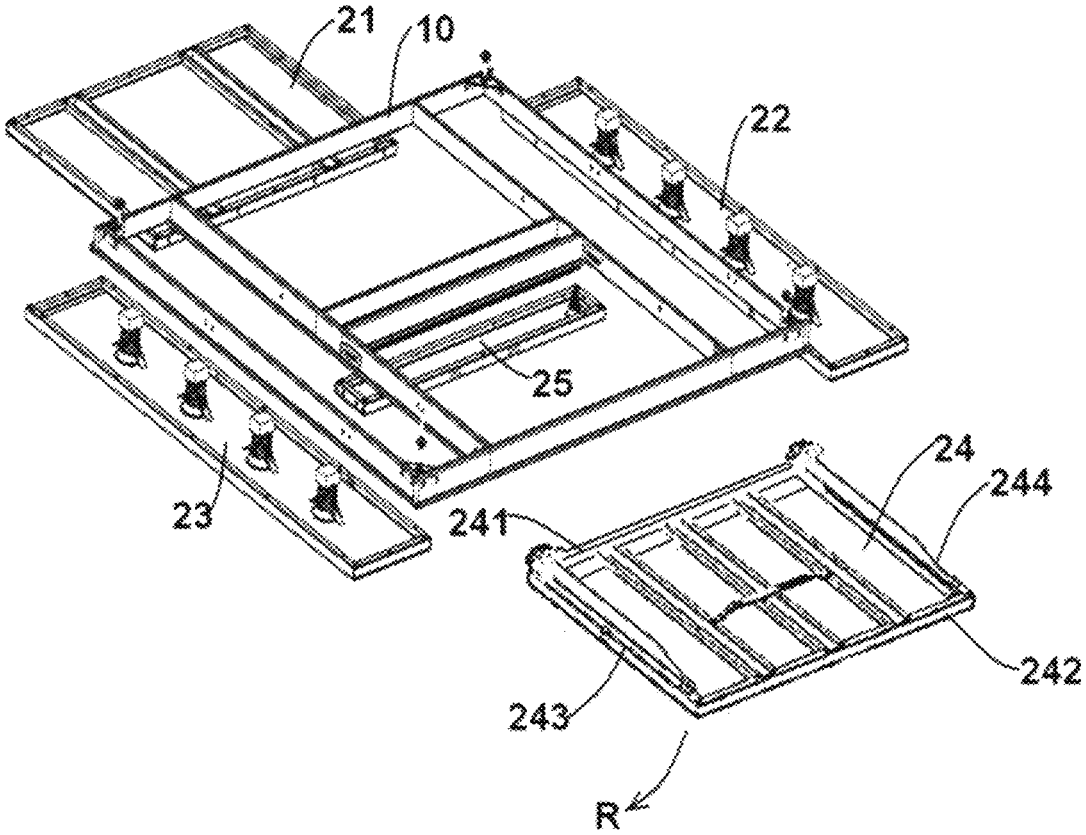
FIG. 3 shows an exploded view of a lift ceiling according to one embodiment of the present invention.

Firstly refer to FIGS. 1 to 3 to describe the lift ceiling 100 according to the embodiments of the present invention in detail. The lift ceiling 100 according to the embodiments of the present invention comprises a support frame 10 and a plurality of extended panels 20 mounted to the support frame 10. The support frame 10 has a shape adapted to a lift car. For example, in general, the lift car has a cubic shape, and the support frame 10 can have a substantially rectangular shape. The support frame 10 can be constructed by lines, that is to say, the support frame 10 can be composed by a plurality of struts in a straight line. For example, in the embodiments shown in FIGS. 1 to 3, the support frame 10 can be composed by a combination of beams the cross section of which can be in a "I" shape, a "Z" shape or a cylindrical shape; each strut can comprise a first strut 11, a second strut 12, a third strut 13 and a fourth strut 14 defining the rectangular outer edge thereof, and a first longitudinal strut 15 and a second longitudinal strut 16 extending inside the rectangular outer edge thereof, and a first lateral strut 17 and a second lateral strut 18 extending between the first longitudinal strut 15 and the second longitudinal strut 16. In alternative embodiments, there can be a non-rectangular outer edge or a lateral or longitudinal or inclined strut in other forms extending in the rectangular or otherwise outer edge. In alternative embodiments, the support frame 10 can have other suitable shapes, for example, circular, oval, diamond, etc. In alternative embodiments, the support frame 10 can be formed into a panel with an opening, and the opening can mate with the openable extended panel and be in positional correspondence to the escape exit at the car roof. The support frame 10 can be connected to the car roof via connection pieces 101, 102, 103 and 104 at four corners thereof or by other means.

The lift ceiling 100 further comprises a plurality of extended panels 20 mounted to the support frame 10. The extended panels 20 can comprise various types of ceiling panels, which can not only serve the decorative function but also can serve the functional use. The various types of panels can be matched according to particular situations of the lift car, so as to diversify the design and functions. Decorative ceilings with different styles, costs and functions can be combined into according to different client requirements. In the embodiments shown in FIGS. 1 to 3, the extended panel 20 comprises: a first panel 22 longitudinally extending along the entire lift ceiling at a first side of the lift ceiling; a second panel 23 longitudinally extending along the entire lift ceiling at a second side of the lift ceiling; and a plurality of intermediate panels laterally extending between the first panel 22 and the second panel 23, for example, one, two or three intermediate panels. In some embodiments, the plurality of intermediate panels comprise three intermediate panels, i.e., a third panel 21, a fourth panel 25 and an openable extended panel 24, so as to realize a symmetrical arrangement. In some embodiments, the third panel 21 and the fourth panel 25 can also be combined, so that there are two intermediate panels. In alternative embodiments, the plurality of extended panels 20 can be in other different arrangements.

In the embodiments shown in FIGS. 1 to 3, especially clearly seen in FIG. 3, the support frame 10 is formed into a line shape, and defines a plurality of rectangular mounting openings, and all of the plurality of extended panels are formed into a rectangular shape, and are mounted in the corresponding mounting openings. It can be seen in FIG. 2 that each rectangular extended panel can be connected to the support frame 10 via a fastening piece or snap arranged along its peripheral, and is suspended below the support frame 10. In alternative embodiments, the plurality of extended panels 20 can be firmly connected to the support frame 10 by other means, for example, they can be mounted in the openings in a flush manner with the support frame 10.

The plurality of extended panels can comprise: a fixed decorative panel, a light source panel and an openable extended panel, etc. In alternative embodiments, any functional or decorative member suitable to be arranged on the lift car ceiling can be integrated in the extended panel, so as to form another new type of extended panel. In the embodiment shown in FIG. 3, among the plurality of extended panels, the third extended panel 21 and the fourth extended panel 25 are fixed decorative panels, and are primarily playing the role of decoration, and the first panel 22 and the second panel 23 are light source panels, and are primarily playing the role of illumination. In alternative embodiments, the fixed decorative panels are exchangeable with the functional extended panels, for example, the third extended panel 21 can be replaced to have a light source, and so like. For the fixed decorative panels, they can have various materials and/or colours so as to be adapted to various lift decoration styles, and so on. The light source panel can comprise a plurality of point light sources or area light sources, so as to illuminate the interior of the lift in different styles. The openable extended panel is in positional correspondence to the escape exit of the car roof, and can be opened by rotating around a pivot shaft, for example, rotating in the direction of the arrow R in FIG. 3.

Figure 4:
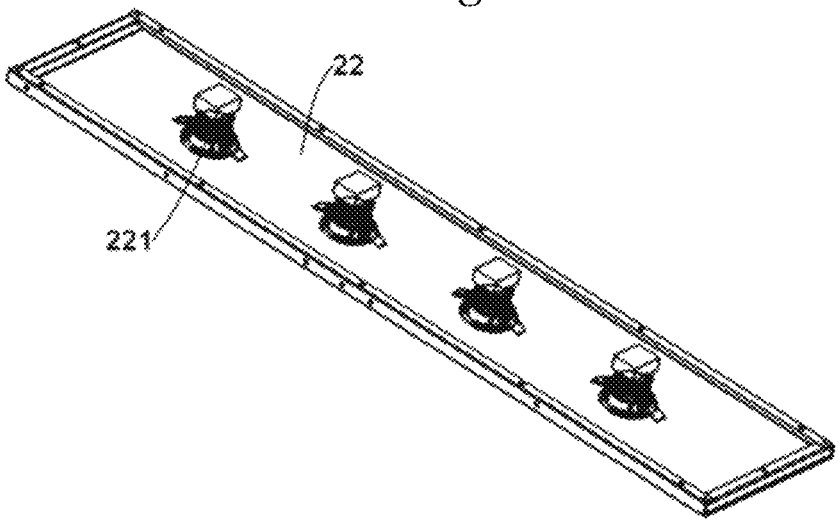
FIG. 4 shows a stereogram of an extended panel according to one embodiment of the present invention.
Figure 5:
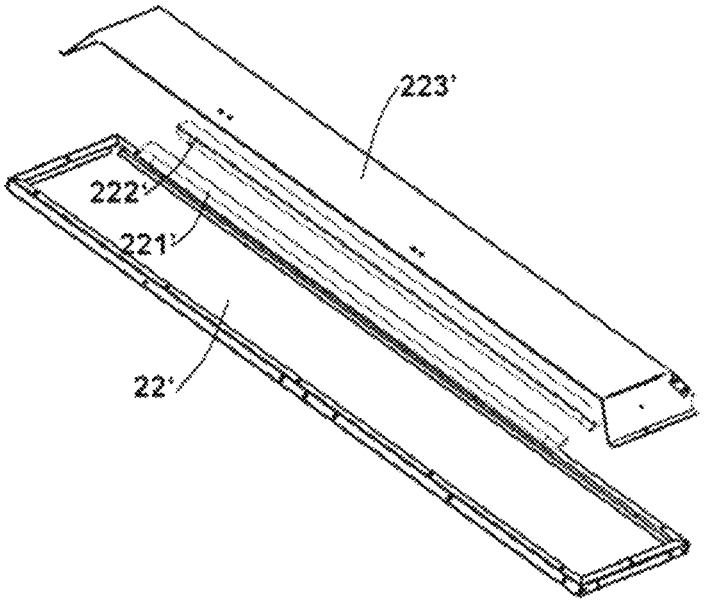
FIG. 5 shows an exploded view of an extended panel according to another embodiment of the present invention.

FIGS. 4 and 5 show two kinds of light source panels. In the embodiment shown in FIG. 4, the light source panel 22 comprises a plurality of point light sources 221 arranged along its length. In the embodiment shown in FIG. 5, the light source panel comprises a base board 22', a top board 223' and a plurality of long tubular light sources 221' and 222' arranged along its length, so that the light source panel forms an area light source. A light source panel with a point light source or with an area light source can be selected according to particular lift car decoration.

Figure 6:
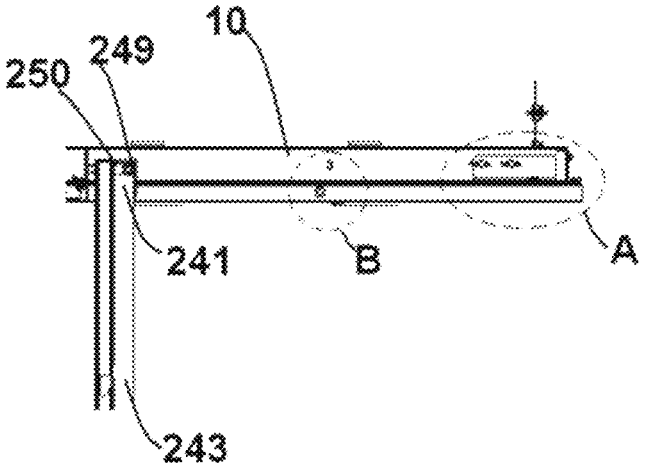
FIG. 6 shows a side view of an openable extended panel according to another embodiment of the present invention.
Figure 7:
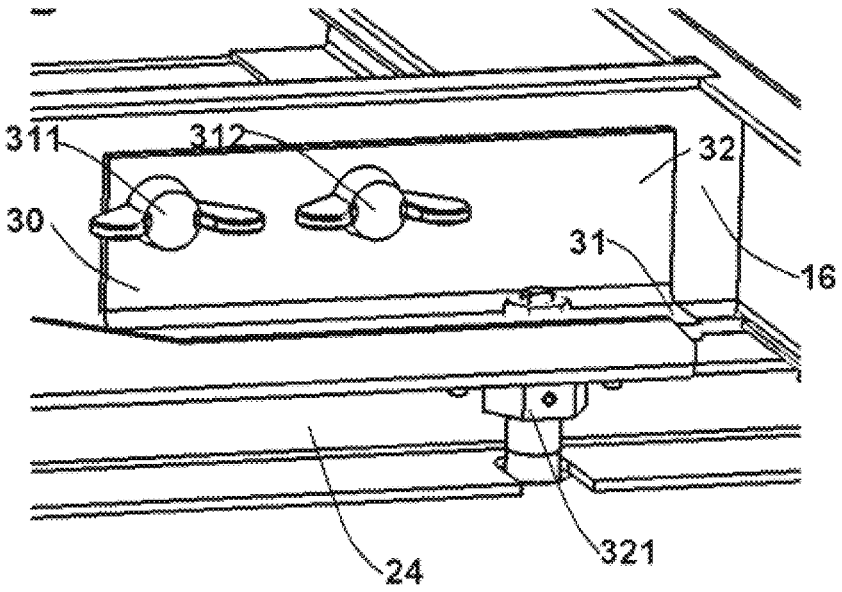
FIG. 7 shows an enlarged view of an A area of the openable extended panel in FIG. 6.
Figure 8:
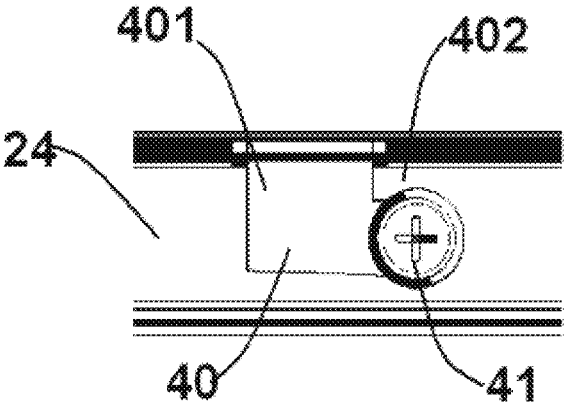
FIG. 8 shows an enlarged view of a B area of the openable extended panel in FIG. 6.

FIGS. 6 to 8 shows an openable extended panel 24 according to the embodiments of the present invention. Though not shown, the openable extended panel 24 is arranged to be in positional correspondence to an escape exit on the car roof. FIGS. 3 and 6 respectively show a closed state and an open state of the openable extended panel 24. In the closed state, the openable extended panel 24 is similar to a fixed decorative panel, and has an appearance matching with the other extended panels so as to construct a part of the lift ceiling decoration. In the open state, the openable extended panel 24 is opened by rotating around the pivot shaft, so as to realize the purpose of escape, the purpose of cleaning the lift ceiling, the purpose of replacing the extended panel or light source, and so on. In some embodiments, the openable extended panel 24 is rotatably connected to an adjacent part of the support frame 10 for example through the pivot shaft at a first side 241, and at a second side 242 opposite to the first side 241, the openable extended panel 24 is connected to the support frame 10 via the intermediate member 30, wherein the support frame 10 and the openable extended panel 24 are respectively detachably connected to the intermediate member 30.

Particularly refer to FIG. 7, an enlarged view of the vicinity of the area A in FIG. 6 is shown. It can be clearly seen that the intermediate member 30 is detachably connected to the openable extended panel 24 and to a part the support frame 10 near the openable extended panel 24, i.e., a second long longitudinal strut 16, respectively. By means of the arrangement, the openable extended panel 24 can be opened from two sides, i.e., the lift car side and the car roof side. In particular embodiments, the intermediate member 30 is connected to the openable extended panel 24 via a first connection piece 321, and the first connection piece 321 can be accessed and disassembled from the lift car side; and the intermediate member 30 is detachably connected to the support frame 10 via the second connection piece 311, 312, and the second connection piece 311, 312 can be accessed and disassembled from the car roof side. In particular embodiments, the intermediate member is optionally a bent board, and the bent plate has a first connecting face 31 and a second connecting face 32 perpendicular to each other, wherein the first connecting face 31 of the bent plate is connected to the openable extended panel 24 via the first connection piece 321 passing through the openable extended panel 24, and the second connecting face 32 of the bent plate is connected to the support frame via the second connection piece 311, 312. In some embodiments, the first connection piece 321 is a connection piece that can only be disassembled by means of a tool so as to prevent the first connection piece being changed arbitrarily, for example, a fastening bolt which has a bolt head at the lift car side and a tail end that can pass through the openable extended panel to the car roof side so as to be connected to the intermediate member. In some embodiments, the second connection piece is a connection piece that can be disassembled by hand, for example a butterfly bolt, so that a personnel at the car roof side can open the openable extended panel by hand.

As shown in FIGS. 6 and 8, the openable extended panel 24 is also provided with an anti-falling mechanism for preventing the openable extended panel 24 from falling down accidentally. More particularly, an anti-falling mechanism for preventing the openable extended panel 24 from falling down accidentally is provided at a third side 243 of the openable extended panel 24 adjacent to the second extended panel 23 and/or a fourth side 244 of the openable extended panel 24 adjacent to the third extended panel 22. It should be appreciated that the anti-falling mechanism can be provided on either or both of the third side and the fourth side of the openable extended panel 24. FIG. 8 shows an enlarged view of the area B in FIG. 6, in which one particular embodiment of the anti-falling mechanism can be clearly seen. In some embodiments, by translating the openable extended panel, the openable extended panel switches between an interfered location where the anti-falling mechanism functions and a released location where the openable extended panel is allowed to be opened. More particularly, in some embodiments, the anti-falling mechanism comprises a guiding slot 40 provided one of the openable extended panel 24 and an extended panel adjacent thereto, and a laterally extending part 41 (shown as a pin in the drawings) provided on the other one of same. The openable extended panel can be translated so that the laterally extending part 41 is aligned with a notch 401 or a stop part 402 of the guiding slot, so as to allow or restrict the rotation of the openable extended panel. More particularly, the laterally extending part 41 in the form of a pin can be a part of the extended panel 22 or 23 adjacent to the openable extended panel. When the openable extended panel 24 is in the closed state, after disconnecting the intermediate member 30 from the openable extended panel 24 or the support frame 10, since the laterally extending part 41 can be aligned with the stop part 402 of the guiding slot in the openable extended panel 24, the openable extended panel 24 cannot rotate to open yet. At this time, the openable extended panel 24 is pushed to translate as a whole to the right for approximately 10 mm, so that the laterally extending part 41 is aligned with the notch 401 of the guiding slot, thus allowing the openable extended panel 24 to rotate to open. In alternative embodiments, the laterally extending part can be arranged on the openable extended panel 24, and the guiding slot can be formed on the adjacent extended panel; at this moment, the notch of the guiding slot should be facing downwards. Furthermore, as shown in FIG. 6, the pivot shaft 249 can be translated in a shaft groove 250, so as to allow the openable extended panel 24 to translate as a whole.

The steps of opening the openable extended panel 24 according to the embodiments of the present invention comprise:

1. disconnecting the intermediate member 30 from the openable extended panel 24 from the lift car side or disconnecting the intermediate member 30 from the support frame 10 from the car roof side;

2. translating the openable extended panel 24 such that the anti-falling mechanism is in a released location; and 3. pivoting the openable extended panel 24 to open the openable extended panel 24.

According to other aspects of the present invention, the present invention is also intended to claim a lift car or lift system having an openable extended panel according to various embodiments of the present invention or having a lift ceiling in the various embodiments.

The advantages of the openable extended panel, the lift ceiling, the lift car or lift system according to various embodiments of the present invention comprise but are not limited to:

having a modular design for providing various decorative and functional combinations of a lift ceiling;

satisfying the requirement of an escape exit; and providing a more quick way to replace a light source or clean a ceiling.

The particular embodiments described above are merely for describing the principle of the invention more clearly, where various components are embodied so that the principles of the invention are more easily to understand. Without departing from the scope of the invention, a person skilled in the art can easily make various modifications to the present invention. Therefore, it should be understood that the scope of the present invention should not be restricted by the particular embodiments above.

What is claimed is:

1. A lift ceiling arranged below a car roof, comprising:

a support frame and a plurality of extended panels mounted to the support frame;

wherein the plurality of extended panels comprise an openable extended panel, and the openable extended panel is aligned with an escape exit of the car roof;

wherein the openable extended panel is rotatably connected to the support frame at a first side, and the openable extended panel is connected to the support frame via an intermediate member at a second side opposite to the first side;

wherein the support frame and the openable extended panel are respectively detachably connected to the intermediate member;

wherein the openable extended panel is also provided with an anti-falling mechanism for preventing the openable extended panel from falling down accidentally;

wherein the anti-falling mechanism comprises: a guiding slot provided on one of the openable extended panel and an extended panel adjacent to the openable extended panel, and a laterally extending part provided on the other one of same, the laterally extending part is aligned to a notch or stop part of the guiding slot by means of the translation of the openable extended panel, so as to allow or restrict the rotation of the openable extended panel.

2. The lift ceiling according to claim 1, wherein the plurality of extended panels also comprise a fixed decorative panel and/or a light source panel.

3. The lift ceiling according to claim 2, wherein the light source panel comprises a point light source or an area light source.

4. The lift ceiling according to claim 1, wherein the support frame is composed of a plurality of struts, and defines a plurality of rectangular mounting openings, and all of the plurality of extended panels are formed in a rectangular shape and are mounted on the corresponding mounting openings.

5. The lift ceiling according to claim 4, wherein the plurality of extended panels comprise:

a first panel longitudinally extending along the entire lift ceiling at a first side of the lift ceiling;

a second panel longitudinally extending along the entire lift ceiling at a second side of the lift ceiling; and at least one intermediate panel laterally extending between the first panel and the second panel.

6. The lift ceiling according to claim 5, wherein the at least one intermediate panel comprises two or three laterally extending intermediate panels.

7. The lift ceiling according to claim 5, wherein the first panel and the second panel are light source panels, and one of the intermediate panels constitutes the openable extended panel.

8. The lift ceiling according to claim 1, wherein the openable extended panel and the intermediate member are connected via a first connection piece, the first connection piece being able to be accessed and disassembled from inside an elevator car, and the support frame and the intermediate member are connected via a second connection piece, the second connection piece being able to be accessed and disassembled from an elevator car roof.

9. The lift ceiling according to claim 8, wherein the intermediate member is a bent plate, and the bent plate has a first connecting face and a second connecting face perpendicular to each other, wherein the first connecting face of the bent plate is connected to the first connection piece passing through the openable extended panel, and the second connecting face of the bent plate is connected to the support frame via the second connection piece.

10. The lift ceiling according to claim 8, wherein the first connection piece is a locking bolt, the locking bolt comprising a head that can be accessed from the lift car side and a tail end that passes through the openable extended panel; and the second connection piece is a butterfly bolt.

11. The lift ceiling according to claim 1, wherein the openable extended panel can be translated, so that the openable extended panel switches between an interfered location where the anti-falling mechanism functions and a released location where the openable extended panel is allowed to be opened.

12. A lift car, wherein the lift car comprises the lift ceiling as claimed in claim 1.

13. A lift system, wherein the lift system comprises a lift car, and the lift car comprises the lift ceiling as claimed in claim 1.

14. An openable extended panel for a lift ceiling, mounted to a support frame and aligned with an escape exit of a car roof;

wherein the openable extended panel is rotatably connected to the support frame at a first side, and the openable extended panel is connected to the support frame via an intermediate member at a second side opposite to the first side;

wherein the support frame and the openable extended panel are respectively detachably connected to the intermediate member;

wherein the intermediate member is a bent plate, and the bent plate has a first connecting face and a second connecting face perpendicular to each other, wherein the first connecting face of the bent plate is connected to the first connection piece passing through the openable extended panel, and the second connecting face of the bent plate is connected to the support frame via the second connection piece.

15. The openable extended panel according to claim 14, wherein the openable extended panel is formed into a rectangle.

16. The openable extended panel according to claim 14, wherein the openable extended panel and the intermediate member are connected via a first connection piece, the first connection piece being able to be accessed and disassembled from inside an elevator car, and the support frame and the intermediate member are connected via a second connection piece, the second connection piece being able to be accessed and disassembled from an elevator car roof.

17. The openable extended panel according to claim 16, wherein the first connection piece is a locking bolt, the locking bolt comprising a head that can be accessed from the lift car side and a tail end that passes through the openable extended panel; and the second connection piece is a butterfly bolt.

18. The openable extended panel according to claim 14, wherein the openable extended panel is also provided with an anti-falling mechanism for preventing the openable extended panel from falling down accidentally.

19. The openable extended panel according to claim 18, wherein the openable extended panel can be translated, so that the openable extended panel switches between an interfered location where the anti-falling mechanism functions and a released location where the openable extended panel is allowed to be opened.

20. The openable extended panel according to claim 18, wherein the anti-falling mechanism comprises: a guiding slot provided on one of the openable extended panel and an extended panel adjacent to the openable extended panel, and a laterally extending part provided on the other one of same, the laterally extending part is aligned to a notch or stop part of the guiding slot by means of the translation of the openable extended panel, so as to allow or restrict the rotation of the openable extended panel.

* * * * *